United States Patent [19]

DeSantis

[11] 4,061,452

[45] Dec. 6, 1977

[54] APPARATUS FOR PRODUCING SPHERICAL ARTICLES

[75] Inventor: Raymond P. DeSantis, Royal Oak, Mich.

[73] Assignee: Wolverine Aluminum Corporation, Lincoln Park, Mich.

[21] Appl. No.: 761,003

[22] Filed: Jan. 21, 1977

Related U.S. Application Data

[63] Continuation of Ser. No. 619,898, Oct. 6, 1975, abandoned.

[51] Int. Cl.[2] ..... B30B 11/02

[52] U.S. Cl. ..... 425/78; 425/416; 425/410

[58] Field of Search ..... 425/78, 116, 408, DIG. 44, 425/DIG. 35

[56] References Cited

U.S. PATENT DOCUMENTS

| | | | |
|---|---|---|---|
| 1,684,984 | 9/1928 | Claus | 425/DIG. 35 |
| 2,411,379 | 11/1946 | Langhammer | 425/78 |
| 3,158,547 | 11/1964 | Smith | 425/116 X |
| 3,255,279 | 6/1966 | Smith | 425/408 |
| 3,328,840 | 7/1967 | Vinson | 425/78 |
| 3,382,540 | 5/1968 | Van De Moden et al. | 425/78 |
| 3,775,032 | 11/1973 | Smith et al. | 425/78 |

*Primary Examiner*—J. Howard Flint, Jr.
*Attorney, Agent, or Firm*—Hauke & Patalidis

[57] ABSTRACT

A press apparatus for compacting powder material into generally spherical articles by way of a tooling arrangement comprising a die having a bore, a punch having an upper face defining a generally hemispherical cavity reciprocably movable along the axis of the die bore and a counterpunch positionable over the opening of the die bore. The lower face of the counterpunch defines a generally hemispherical cavity of the same diameter as the generally hemispherical cavity defined by the face of the punch. The generally hemispherical cavities are in alignment with each other and define a spherical mold cavity. During the compacting step, the counterpunch is positioned with its lower face abutting the upper surface of the die plate and compaction of the powder material is achieved entirely by movement of the punch in an upward direction.

4 Claims, 7 Drawing Figures

APPARATUS FOR PRODUCING SPHERICAL ARTICLES

This is a continuation of application Ser. No. 619,898, filed Oct. 6, 1975, now abandoned.

BACKGROUND OF THE INVENTION

1. Field of the Invention

The present invention relates to apparatus for compacting powder into a generally spherical form. More particularly, it relates to an improved punch and die arrangement for such apparatus in which the counterpunch does not penetrate the die bore during the compaction step.

2. Description of the Prior Art

The present invention is concerned with improved tooling for use in powder-compacting presses such as are disclosed in U.S. Pat. Nos. 3,826,599; 3,775,032; 3,730,659; 3,726,622; 3,645,658; 3,574,892; 3,561,056; 3,415,142; 3,344,213 and 3,328,840, all of which are assigned to the same assignee as the present invention.

In the powder-compacting presses disclosed in the aforementioned U.S. patents, the articles are compacted and formed in a multi-cavity die forming part of a punch and die set, with the finished articles being automatically ejected from the die cavities, picked up by a vacuum pick-up head, and conveyed into suitable receptacles. A work station positioner assembly, which is part of the press, is mounted angularly movable transversely over the die plate and carries a powder dispenser, an anvil and the pick-up head. The powder dispenser, which is supplied with powder from a primary powder supply means connected thereto by means of a flexible tubing or the like, is first positioned over the die cavity or cavities which are thus filled with powder as the punches are displaced downwardly so as to draw a predetermined amount of powder into the die cavity or cavities. The dispenser is then removed from above the die cavity or cavities by the subsequent angular motion of the station positioner assembly, and the anvil is, in turn, positioned over the die cavities. The anvil is clamped over the die cavity by means of a pivotable clamp supported about the anvil and actuated in timed relation with the movement of the punches. The anvil is held down with sufficient pressure to permit the compaction of the powder against the anvil as a result of an upward motion of the punches into the die cavity or cavities. The anvil is then removed from its position over the die cavity or cavities and is replaced by the pick-up head by a further angular motion of the work station positioner transversely across the face of the die plate. The punches are disposed upwardly so as to bring their upper ends in substantial flush alignment with the upper surface of the die plate, such that the finished compacted articles are ejected from the die cavities and picked up by the pick-up head. As the result of a return angular motion of the work station positioner to the initial fill position, the pickup head is removed from over the die cavity and is disposed over one or, if a plurality of die cavities are employed, a series of discharge apertures arranged in a disposition similar to the arrangement of the die cavities in the die plate, and the finished compacted article or articles are drawn, as by vacuum, through the discharge aperture or apertures into a container or separate containers.

The tooling used in the prior art for compacting powder materials into spherical articles consists of a die having a center bore and upper and lower punches, the faces of which define hemispherical cavities. Powder material is charged in a measured quantity into die bore and hemispherical cavity of the lower punch. The upper punch is then moved through the bore and compacts the powder in the spherical cavity defined by the upper and lower punches. Thus, compaction of the powder material is effectuated by movement of the upper punch and the compacted article is positioned entirely within the confines of the die bore prior to ejection.

The present invention provides an apparatus for producing a compacted spherical article partly in a die bore rather than entirely within the bore.

SUMMARY OF THE INVENTION

In accordance with the present invention, a generally spherical article is compacted in a molding or forming cavity defined between the upper face of a lower punch and the lower face of an upper counterpunch. The lower punch is capable of reciprocal movement within the bore of a cylindrical die. In material-charging position, the face of the punch is positioned within the die bore and powder material is charged into the cavity formed by the punch face and wall of the bore. The counterpunch is then positioned with its face level with the upper surface of the die plate. The powder material is then compressed and compacted by movement of the punch toward the counterpunch.

DETAILED DESCRIPTION OF THE PREFERRED EMBODIMENT

Figure 1:
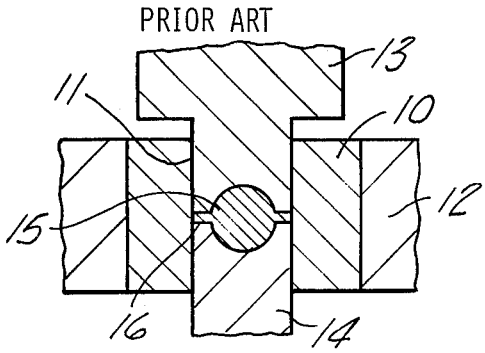
FIG. 1 is a broken sectional view of a die with upper and lower punches illustrating the prior art apparatus and method for forming spherical articles from powder materials.
Figure 2:
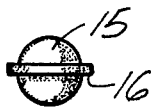
FIG. 2 is a view of a spherical article with an equatorial bulge as produced by the prior art apparatus and process illustrated in FIG. 1.
Figure 5:
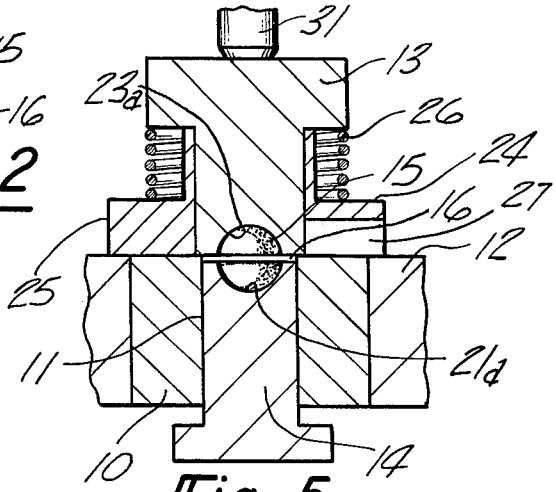
FIG. 5 is a broken sectional view similar to FIG. 4 but with both punch and counterpunch members in compacting position.

Referring to FIG. 1, which illustrates the prior art, a die 10 of cylindrical configuration has an axial die bore 11. The die 10, which is sometimes referred to as a "die bushing", is normally composed of a very hard material such as cemented tungsten carbide. The die bushing 10 is supported by being press-fitted or otherwise fastened in a bore of a die plate 12 which may be made of tungsten carbide or hardened steel and the like. The die plate 12 is mounted in the table or bed of a press apparatus (not shown).

The die bore 11 accommodates an upper punch 13 and a lower punch 14 which are reciprocally movable therein. The end faces of the punches 13 and 14 are each provided with a hemispherical cavity. With the upper punch 13 out of engagement from within the die 10, a measured amount of powder material is poured in the hemispherical cavity of the lower punch 14 and in the die bore 11 of the die 10.

The upper punch 13 is then moved into the die bore 11 and the lower punch 14 is moved upwardly into compacting engagement with the powder material to compact it into a spherical form as shown at 15. During the compacting stroke, a portion of the powder material is caused to project between the end surfaces of the upper punch 13 and lower punch 14, thus forming an equatorial bulge 16. The bulge 16 is subsequently removed by tumbling or a similar process.

The apparatus of the present invention will be described with particular reference to FIGS. 4–7, illustrating, for illustrative purposes only, the molding of a spherical article. As shown in these FIGS., the upper punch, or counterpunch, 13 does not at any time enter the die bore 11 and thus the compaction steps takes place at the surface of the die 10 rather than deep within the die bore 11.

The lower punch 14 has an end face 21 provided with a hemispherical cavity **21*a* and the counterpunch 13 has a face 23 provided with a hemispherical cavity 23*a* which mates with the hemispherical cavity 21*a* to form a spherical cavity when the upper and lower punches are in proximity to each other. Mating alignment of the hemispherical cavities 21*a* and 23*a* is aided by a guide anvil 24 having a bore 25 (FIGS. 4–6) accepting the counterpunch 13. The anvil bore 25 guides the counterpunch 23 during its reciprocal movement. A spring 26 normally urges the counterpunch 13 away from within the anvil bore 25 and tends to apply the anvil 24 against the surface of the die plate when the counterpunch 13 is in the position indicated at FIGS. 3 and 4. A slot 27 is radially disposed through the wall of the anvil 24. A ram 31 (FIGS. 4–5) actuates the counterpunch 13 for reciprocal movement, the ram 31** being driven by the press mechanism, not shown.

Figure 3:
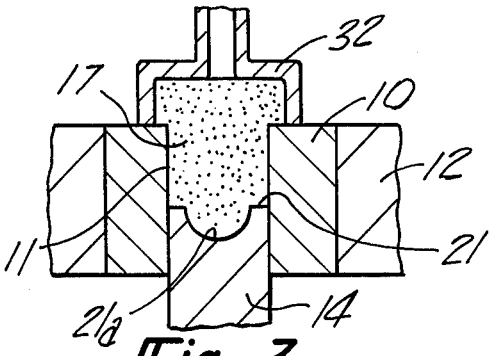
FIG. 3 is a broken sectional view of a die and punch according to the present invention showing the charging of powder material to the apparatus.

As shown at FIG. 3, the upper punch 13 and guide anvil 24 have been removed from over the die 10 and a powder-charging dispenser 32 is first placed over the cavity formed by the hemispherical cavity **21*a* of the punch 14 and the wall of the die bore 11. A charge of powder material flows by gravity into the charging cavity formed by the die bore 11 and hemispherical cavity 21*a*, the punch being preferably downwardly displaced to draw powder material into the die cavity. After charging with the powder material 17, the dispenser 32 is moved to one side of the die 10 to leave a powder charge level with the end surface of the die 10** and wiping the surface of the die plate.

Figure 4:
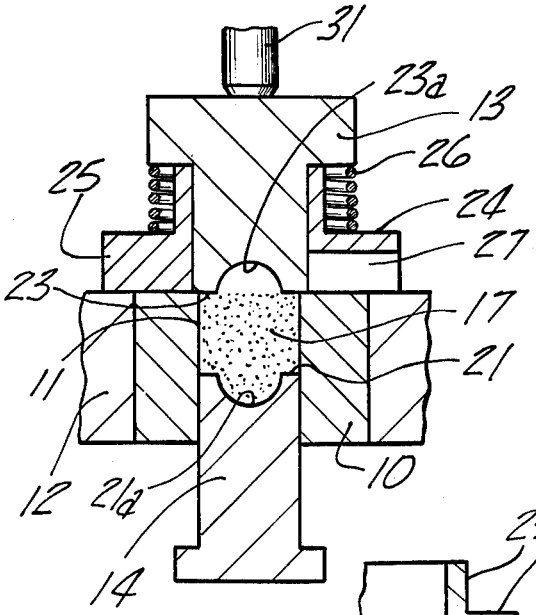
FIG. 4 is a broken sectional view of the apparatus of the invention showing the counterpunch clamped over the die cavity prior to the powder material compaction step.

The guide anvil 24 is subsequently brought into the position illustrated at FIG. 4. The counterpunch 13 is advanced through the anvil bore 25 until its face 23 engages the end face of the die 10, thus compressing the coil spring 26 and applying the face of the anvil 24 firmly against the surface of the die plate 12. Preferably, the counterpunch 13 is provided with an abutment engaging the top of the spring 26 which, in the position illustrated at FIGS. 4 and 5, engages the top surface of the anvil 24, thereby preloading it and applying it firmly against the die plate surface. The punch 14 is moved to the position illustrated at FIG. 5. This compresses and compacts the powder material 17 to its compacted form 15.

Figure 6:
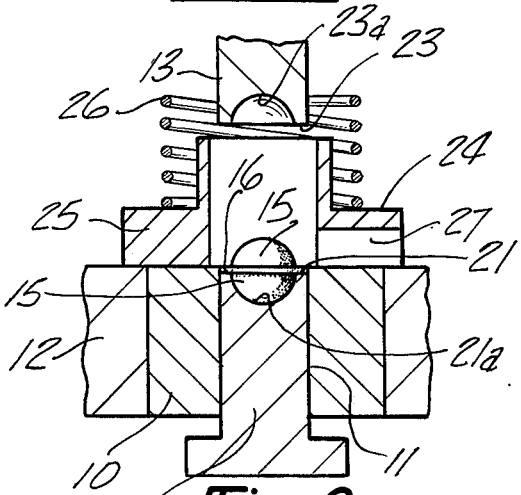
FIG. 6 is a broken sectional view similar to FIG. 5 but with the counterpunch withdrawn after compaction of the material.

The counterpunch 13 is then withdrawn from the anvil bore 25, as illustrated at FIG. 6, and the anvil is displaced to the left, as seen in the drawing, the slot 27 through the wall of the anvil affording clearance for the top of the article 15.

Figure 7:
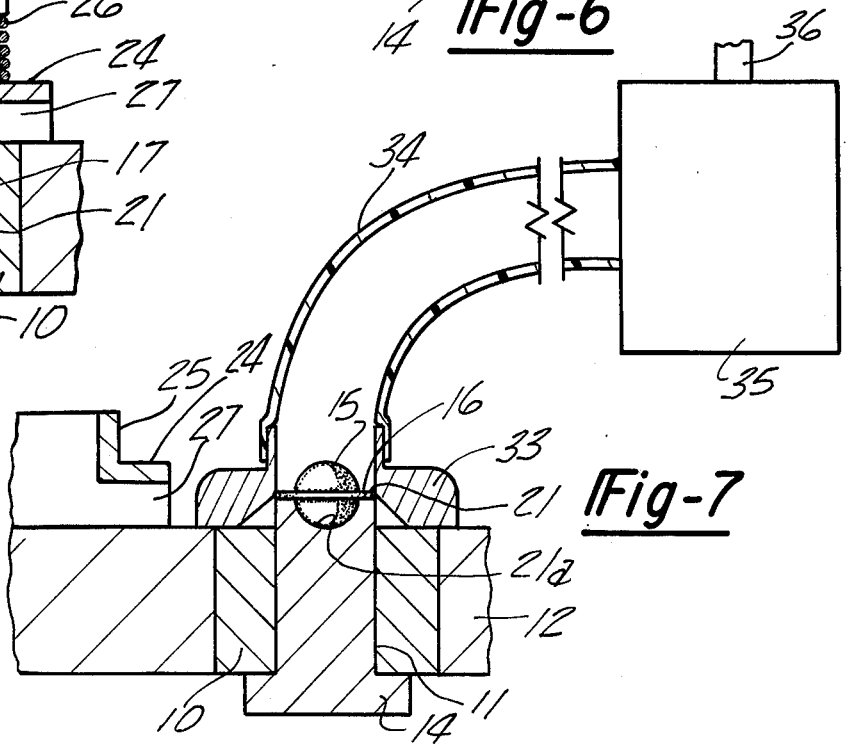
FIG. 7 is a broken sectional view of the die and with the punch in ejection position and article pick-up head in place.

Finally, the punch 14 is displaced through an ejection stroke, as illustrated at FIG. 7. After the spherical article 15 has been ejected from the die cavity by the punch 14, it is drawn by means of a pick-up head 33 and flexible tube 34 into a receptacle 35 which is maintained under vacuum by means of a flexible tube 36 connected to a vacuum pump (not shown). Other conveyance means may also be used.

The compacted article 15 with its equatorial bulge 16 is then subjected to a process, such as tumbling, to remove the equatorial bulge 16. The spherical article 15 is then ready for a sintering step, if required, to provide a final article.

In the present invention only the punch 14 must be dimensioned for reciprocal movement through the die bore 11. The counterpunch 13 is made over-sized compared to the die bore size to provide a massive member having a long service life. The equatorial bulge is much less bulky than that obtained by conventional apparatus.

In order to prevent powder particles from adhering to the end face of the counterpunch 13, cleaning and wiping means, such as a brush (not shown), translated across the end face when in its retracted position may be provided, as disclosed in detail in copending application Ser. No. 619,855, and 761,333 filed contemporaneously herewith.

It will be appreciated that shapes other than strictly geometrically spherical may be molded by way of the apparatus of the invention, such shapes being referred to as "generally spherical".

It is to be understood that the example of the present invention as disclosed herein constitutes one preferred form and that other forms might be adopted, all within the spirit of the invention and the scope of the appended claims.

We claim:

1. An apparatus for compacting powder material into a spherical article, said apparatus comprising a punch and die assembly comprising a stationary die plate, a bore in said die plate, a punch disposed reciprocably in said bore, a compacting face on the end of said punch forming a first half-mold cavity and an annular surface surrounding said first half-mold cavity, a counterpunch having a flat annular end surface engageable with said die plate and overlapping the bore in said die plate without penetrating into said bore, a second half-mold cavity disposed within said counterpunch end annular surface, said second half-mold cavity being of a diameter equal to and being alignable with said first half-mold cavity alignable with said first half-mold cavity, means for reciprocating said punch to a position for compacting said powder material in a molding cavity formed by said first and second half-mold cavities, support and guide means for said counterpunch provided with an end face in constant engagement with said die plate, means for applying a clamping force to said counterpunch with the overlapping portion of the flat end surface thereof in engagement with said die plate, abutment means on said counterpunch for engagement with said support and guide means for transmitting said clamping force to said support and guide means, and a slot in said support and guide means providing clearance for said article partially projecting from said die plate during lateral motion of said support and guide means subsequent to release of said clamping force.

2. The apparatus of claim 1 wherein said bore is in a die bushing disposed in said die plate and the flat end face of said counterpunch is engageable with an end of said bushing.

3. The apparatus of claim 1 wherein said clamping force is transmitted by said abutment to said support and guide means by spring bias means.

4. The apparatus of claim 1 wherein said powder compacting face is concave and forms a hemisphere, and said second half-mold cavity is a complementary hemisphere.

* * * * *

UNITED STATES PATENT OFFICE

CERTIFICATE OF CORRECTION

Patent No. 4,061,452 Dated December 6, 1977

Inventor(s) Raymond P. DeSantis

It is certified that error appears in the above-identified patent and that said Letters Patent are hereby corrected as shown below:

Column 1, line 53, "disposed" should be --displaced--.

Column 3, line 35, "23" should be --13--.

Column 4, line 57, delete "alignable with said first half-mold cavity"

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*